US006554505B1

(12) United States Patent
Twist

(10) Patent No.: US 6,554,505 B1
(45) Date of Patent: Apr. 29, 2003

(54) METHOD AND APPARATUS FOR PROCESSING A PHOTOGRAPHIC MATERIAL

(75) Inventor: Peter J. Twist, Gt. Missenden (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/856,395

(22) PCT Filed: Dec. 14, 1999

(86) PCT No.: PCT/GB99/04215

§ 371 (c)(1),
(2), (4) Date: May 22, 2001

(87) PCT Pub. No.: WO00/38009

PCT Pub. Date: Jun. 29, 2000

(30) Foreign Application Priority Data

Dec. 19, 1998 (GB) ..... 9827976
Oct. 18, 1999 (GB) ..... 9924458

(51) Int. Cl.[7] ..... G03D 5/00

(52) U.S. Cl. ..... 396/604; 396/605; 396/620; 396/627

(58) Field of Search ..... 396/604–606, 396/609, 618, 625, 627, 628, 633, 635, 636; 355/27–29, 40, 41, 77; 134/64 P, 64 R, 122 P, 122 R

(56) References Cited

U.S. PATENT DOCUMENTS

| | | | | |
|---|---|---|---|---|
| 2,848,931 A | | 8/1958 | Troidl | 396/575 |
| 3,192,846 A | * | 7/1965 | Wright | 396/626 |
| 3,221,755 A | | 12/1965 | Wright | 134/122 R |
| 3,314,351 A | | 4/1967 | Duffield et al. | 396/605 |
| 3,363,530 A | | 1/1968 | Rice | 396/605 |
| 4,399,212 A | | 8/1983 | Boie et al. | 134/64 P |
| 5,357,305 A | * | 10/1994 | Long | 396/605 |

* cited by examiner

*Primary Examiner*—Della Rutledge
(74) *Attorney, Agent, or Firm*—Frank Pincelli

(57) ABSTRACT

A method of processing light sensitive material by the surface application of fresh processing solution to the surface of a moving belt by means of an applicator. The material to be processed is brought into moving contact with the moving belt, the resulting relative motion providing a high level of agitation and mixing of the processing solution.

12 Claims, 3 Drawing Sheets

METHOD AND APPARATUS FOR PROCESSING A PHOTOGRAPHIC MATERIAL

FIELD OF THE INVENTION

This invention relates to photographic processing apparatus and is more particularly concerned with the application of photographic processing solutions to the material to be processed.

BACKGROUND OF THE INVENTION

It is known to apply processing solutions to the material by passing the material through a number of tanks or reservoirs containing the required solutions. Such arrangements require large volumes of processing solutions in order to operate effectively. This means that the processing solutions used need to be stable for relatively long periods of time.

To overcome the necessity of maintaining large tanks of relatively unstable solution further methods were developed in which the solutions are applied to the surface of the material being processed. In this method the processing chemicals required can be kept separately until just before they are needed.

There are however disadvantages with surface application. The chemicals are static on the surface of the material being processed. There is thus no agitation and so chemical activity is low. "Instant seasoning" effects cause halide build-up and slows down the processing. It is difficult to achieve uniformity due to the limited amount of processing solution which is being applied to the material. Furthermore, the usage rates of the processing chemicals is high as there is substantially no sideways mixing of chemicals on the surface of the material.

PROBLEM TO BE SOLVED BY THE INVENTION

It is an object of the invention to provide a method and apparatus which overcomes the problems mentioned above.

SUMMARY OF THE INVENTION

According to the present invention there is provided a method of processing light sensitive material by the surface application of processing solution wherein fresh processing solution is applied to the surface of a moving belt by means of an applicator and the material to be processed is brought into moving surface contact with the moving belt, the resulting relative motion providing a high level of agitation and mixing of the processing solution.

Preferably, either or both of the processing solution and the material is heated prior to contact with the belt. The applicator may be movable. This enables either counter current or co-current processing.

The invention further provides an apparatus for processing light sensitive material, the apparatus comprising a flexible belt, first drive means for driving the belt, at least one applicator for applying fresh processing solution to the surface of the belt, and second drive means for transporting the material to be processed in contact with the surface of the belt and at a slower speed than the belt, the resulting relative motion providing a high level of agitation in the processing solution.

ADVANTAGEOUS EFFECT OF THE INVENTION

The method provides very high agitation and allows the use of a higher temperature than is practical in conventional tanks. Processing is therefore more rapid than in prior art processes. Chemical usage is economical because the method applies replenisher at low rates to the paper surface. As stated, the method can be counter-current, which is preferable for washing, or co-current, which is preferable for development. It is possible to change a single stage of the process from one type to another by changing the applicator. The method is ideal for unstable processing solutions such as those used for RX or RedoX amplification processing.

The above and other objects, features and advantages of the present invention will become apparent from the following description of preferred embodiments, in connection with the accompanying drawings, in which:

DETAILED DESCRIPTION OF THE INVENTION

Figure 1:
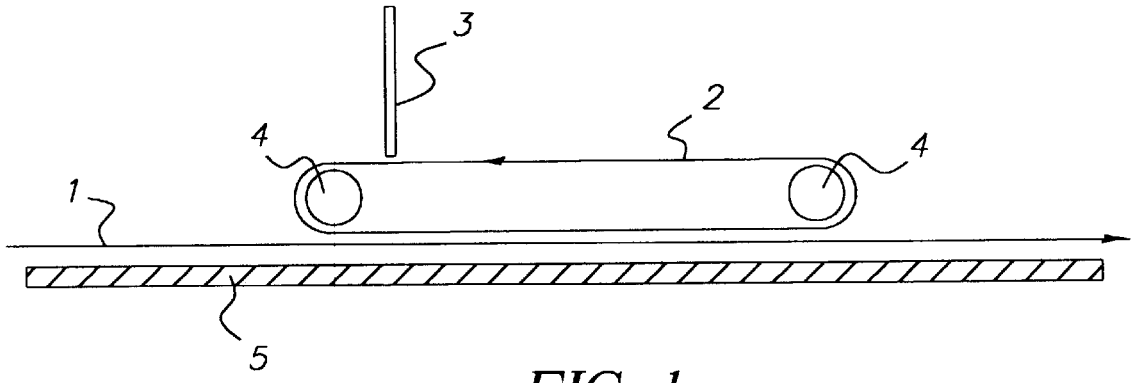
FIG. 1 is a schematic view of a first embodiment of the invention.

FIG. 1 shows a simple horizontal belt arrangement. The belt 2 is driven by rollers 4. An applicator 3 is provided above the belt arrangement. A heater 5 is provided below the belt arrangement.

Material to be processed 1, from now on described as paper, is transported by drive rollers, not shown. The paper 1 is transported with the sensitised side face up and in contact with the lower surface of the belt 2. The belt is driven at a rate faster than the transport rate of the paper 1. Processing solution is applied to the surface of the belt 2 by means of the applicator 3. The solution supplied is fresh, unseasoned solution from a reservoir. This is the case for all embodiments described. It is possible to provide more than one applicator. Each applicator can supply the same or different processing solutions, either simultaneously or sequentially to the surface to the belt. Replenisher can be applied from a made-up solution or from concentrates which can be mixed with water on the belt or before application. It is intended to apply low volumes of processing solution to minimise waste and provide chemical economy. The small amount of waste solution produced is collected in a tray or removed by means of vacuum squeegees. The heater 5 heats the paper before and during its contact with the belt 2. Heating can also be provided by means of hot air directed at the paper or belt. It is also envisaged that the processing solution applied to the belt can be heated. The temperature can be higher than practical in a conventional tank because the paper and solution are heated and then used immediately.

Figure 2:
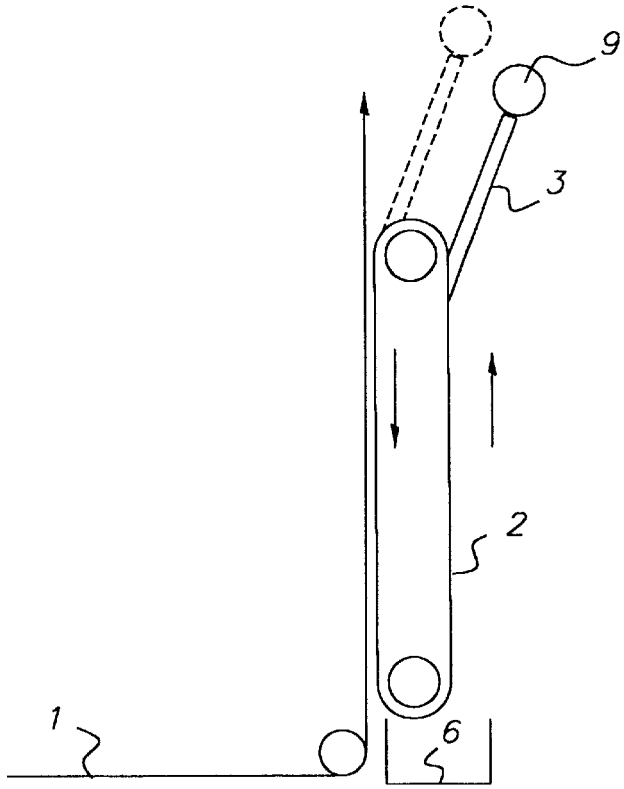
FIG. 2 is a schematic view of a second embodiment of the invention.

FIG. 2 shows a second embodiment of the invention. In this embodiment the belt is arranged vertically. The applicator 3 and a metering pump 9 are provided towards the top of the belt arrangement 2. A collection tray 6 is provided below the belt arrangement.

In this embodiment paper 1 passes with the emulsion face in contact with the belt 2 surface. Processing solution is added to the belt surface by means of the applicator 3 and the metering pump 9 so as to provide counter-current flow. Fresh or "clean" solution is added at the top of the belt 2. This solution seasons and becomes "dirty" on the way down. Seasoned or "dirty" solution drains off the belt 2 and into the collection tray 6. In this embodiment the applicator 3 is movable and the point of application can be changed to any other position, for example at the position shown by dotted lines. It is desirable for counter-current flow that the seasoned solution completely drains off the belt 2 as it moves up to the point of application of fresh solution. This can be facilitated by means of effective squeegees on the upward side of the belt 2.

Counter-current processing is particularly effective for washing or stabilisation. The method can also be applied to co-current processing if the belt 2 revolves in the opposite direction to that shown in FIG. 2 or the fresh solution is applied at the bottom of the belt 2.

Figure 3:
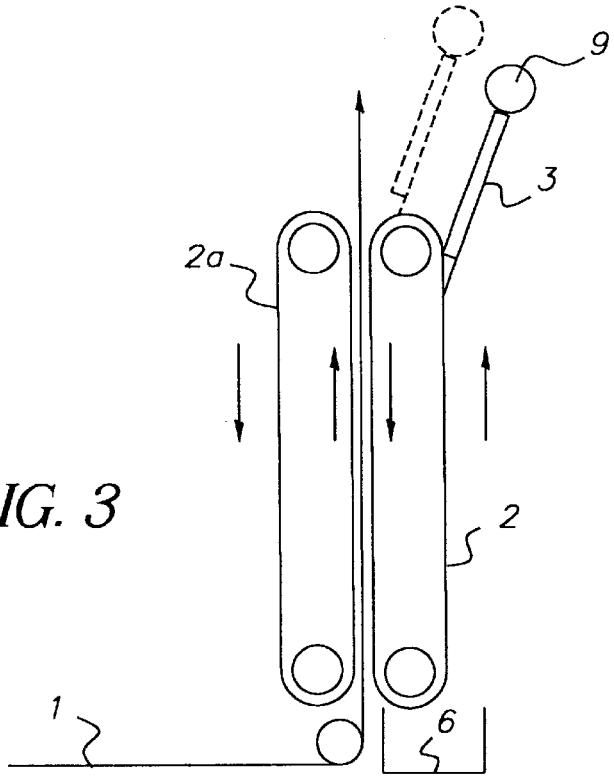
FIG. 3 is a schematic view of a third embodiment of the invention.

FIG. 3 shows a third embodiment of the invention. This embodiment is identical to that shown in FIG. 2 with the addition of a second belt arrangement 2*a*.

The second belt arrangement 2*a* is provided in parallel to belt arrangement 2. Paper passes through with the emulsion surface in contact with the belt surface 2. Second belt 2*a* is provided to wash the back of the paper. The second belt arrangement can be supplied with its own source of processing solution, not illustrated.

Figure 4:
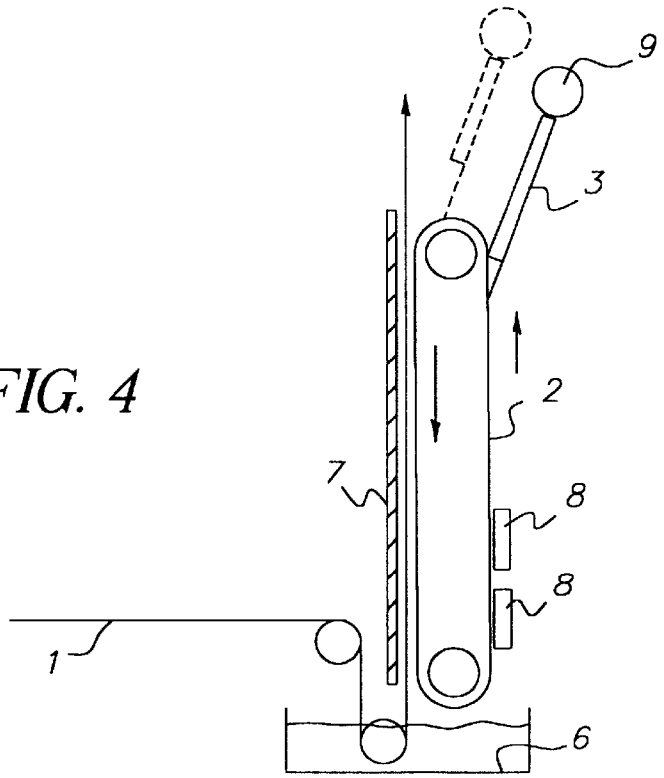
FIG. 4 is a schematic view of a fourth embodiment of the invention.

FIG. 4 shows a fourth embodiment of the invention. The belt arrangement 2, applicator 3, metering pump 9 and collection tray 6 are as described with respect to FIG. 2.

A heater plate 7 is provided in parallel to the belt arrangement 2. Squeegees 8 are provided at the lower part of the belt arrangement 2.

Figure 5:
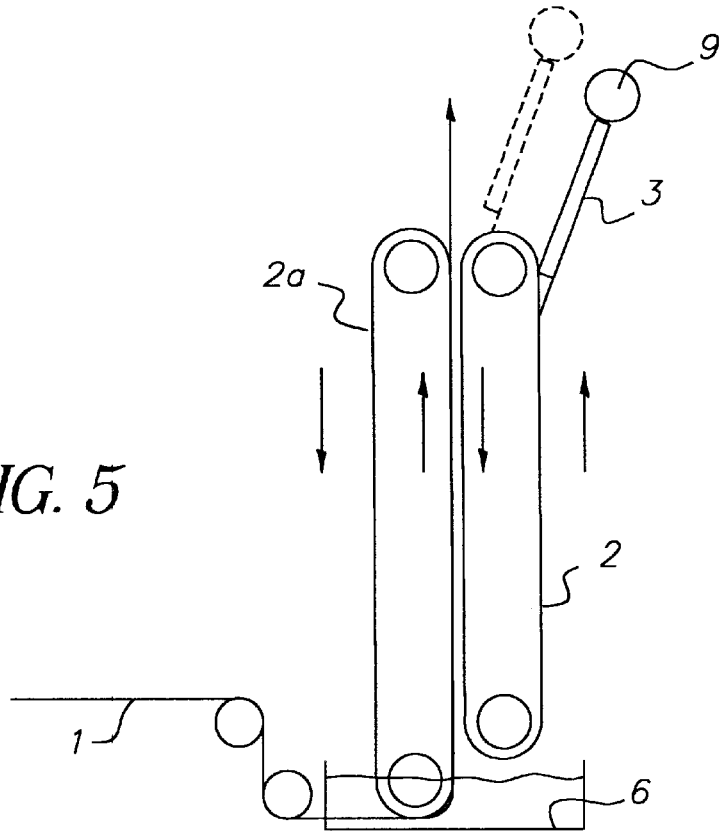
FIG. 5 is a schematic view of a fifth embodiment of the invention.

In this embodiment the paper 1 passes through the tray 6 prior to passing past the belt arrangement 2. The tray contains the seasoned processing solution that falls off the bottom of the belt 2 as described with respect to FIG. 2. The seasoned processing solution pre-wets the paper 1 before the paper contacts the belt 2 carrying the fresh solution. The heater 7 heats the back of the paper 1 to accelerate processing. As the belt rotates squeegees 8 remove the seasoned processing solution FIG. 5 shows a fifth embodiment of the invention. This embodiment is similar to that shown in FIG. 3. The belt arrangement 2, second belt arrangement 2*a*, applicator 3 and metering pump 9 are all as described with respect to FIG. 3. However, in this embodiment the paper passes through tray 6, as described with respect to FIG. 4, to pre-wet the paper 1 prior to contacting the belt surface 2. The tray 6 contains seasoned water.

Figure 6:
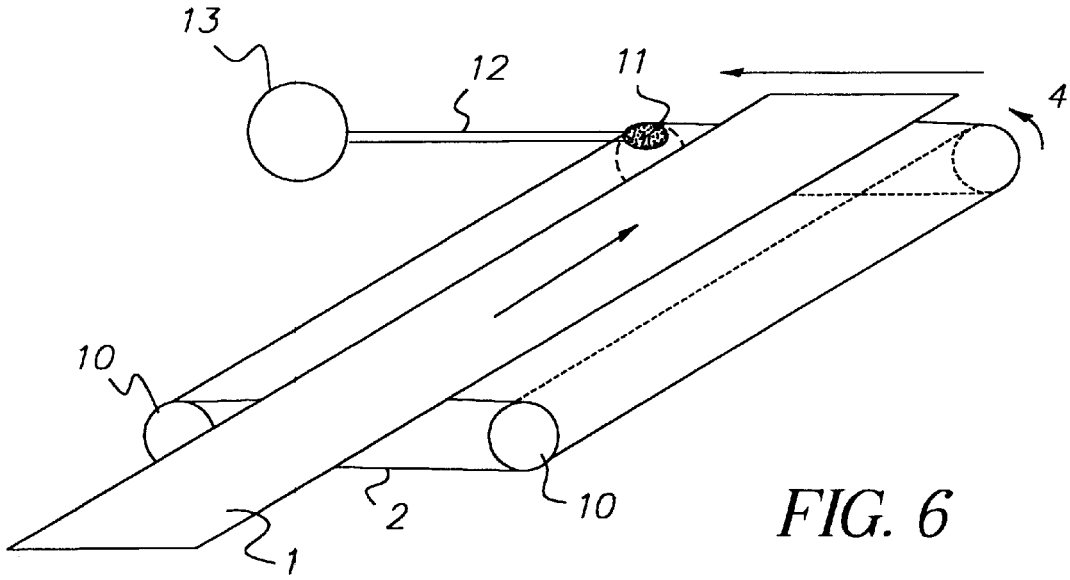
FIG. 6 is a schematic view of a sixth embodiment of the invention.

FIG. 6 shows a sixth embodiment of the invention. In this embodiment the belt 2 is arranged to revolve sideways, perpendicular to the direction in which the paper 1 travels. The belt 2 is driven by longitudinal rollers 10. An applicator 11 is provided to apply processing solution to the belt 2 from a supply pipe 12 and metering pump 13.

In this embodiment the paper 1 is provided with transport rollers (not shown) and guides or rollers (not shown) to prevent sideways movement across the moving belt 2. The paper is transported with the sensitised side face down and in contact with the surface of the belt 2. Processing solution is applied to the surface of the belt 2 by means of the applicator 11. The belt assembly 2 can be angled if counter-current solution flow is desired. Solution added at the top of the belt 2 will flow down to the bottom. The belt assembly can be arranged at an angle from zero degrees (horizontal) to 90 degrees (vertical) depending on the speed of solution flow required. More than one applicator 11 may be provided if required. The same or different processing solutions can be applied separately or at the same time. Processing solution can be supplied from a made-up replenisher or from separate replenisher—concentrates which can be mixed with water on the belt or just before application. The paper and processing solution can be heated to a higher temperature than normally practical in a conventional tank thus facilitating rapid processing. The apparatus is ideal for the application of unstable processing solutions such as those used by RX or RedoX amplification processing. RX processing solutions can be mixed on the belt or just before application.

In the apparatus described above and illustrated in FIGS. 1 to 6 processing solution replenisher is applied through an applicator at the normal replenishment rate to a flexible belt which contacts the surface of the sensitised material. The flexible belt moves over the surface of the paper, mixes processing solution and provides a very high level of agitation. This high level of agitation is conducive to rapid processing. In addition, since only a small volume of solution is present on the belt at any one time, the temperature of the belt-paper combination can be higher than is normally practical in a conventional processing tank. This is further conducive to rapid processing. Furthermore since only small volumes are present on the belt at any one time the method is applicable to unstable processing solutions such as those used in RX or RedoX amplification. In this case the unstable solutions can be mixed on the belt or just prior to application. Since the processing solution applied is "replenisher", which would conventionally have been used to replenish a tank of working strength solution, the method is very economical and also "apparently dry". Replenisher is supplied from a normal replenisher tank or, alternatively, from separate concentrates and water which are mixed just before or during application to the belt surface.

In addition the system provides a stable processing method since the processing solution is only heated as it is applied to the belt. The method also overcomes the problem of "instant" seasoning and the consequent inhibition found with static surface application by virtue of the very effective mixing of applied solution on the surface during the processing time. The belt is arranged so as to move over the whole paper surface several times during the processing time which also overcomes the non-uniformity problem associated with static surface application. The method thus gives rapid, even, stable, economical and apparently dry processing.

More than one applicator may be provided. In this case, each applicator can supply the same or different processing solutions, either simultaneously or sequentially, to the surface of the belt.

The present invention has been described in detail with reference to several preferred embodiments. It will be understood by those skilled in the art that variations and modifications may be effected within the scope of the invention.

What is claimed is:

1. Apparatus for processing light sensitive material, the apparatus comprising a flexible belt, first drive means for driving the belt, at least one applicator for applying fresh processing solution to the surface of the belt, the applicator being movable relative to the belt to enable different points of application to the belt, and second drive means for transporting the material to be processed in contact with the surface of the belt and at a slower speed than the belt, the resulting relative motion providing a high level of agitation in the processing solution.

2. Apparatus as claimed in claim 1 wherein heating means is provided for heating the material to be processed.

3. Apparatus as claimed in claim 1 wherein heating means is provided for heating the processing solution immediately prior to application to the surface of the belt.

4. Apparatus as claimed in claim 1 wherein at least one squeegee is provided for removal of waste processing solution.

5. Apparatus as claimed in claim 1 wherein a collection tray is provided for collection of waste processing solution.

6. A method of processing light sensitive material by the surface application of processing solution wherein fresh processing solution is applied to the surface of a moving belt by means of at least one applicator and the material to be processed is brought into moving surface contact with the moving belt, the resulting relative motion providing a high level of agitation and mixing of the processing solution, the applicator being movable relative to the belt to enable different points of application to the belt.

7. A method as claimed in claim 6 wherein the material to be processed is heated during contact with the belt.

8. A method as claimed in claim 6 wherein the processing solution is heated immediately prior to application to the belt surface.

9. A method as claimed in any of claim 6 wherein waste processing solution is collected from the surface of the belt.

10. A method as claimed in claim 6 wherein the material to be processed passes through the waste processing solution prior to coming into surface contact with the belt.

11. A method as claimed in claim 6 wherein two or more processing solutions are applied simultaneously to the surface of the belt.

12. A method as claimed in claim 6 wherein two or more processing solutions are applied sequentially to the surface of the belt.

* * * * *